United States Patent [19]

Pavel

[11] Patent Number: 4,873,812

[45] Date of Patent: Oct. 17, 1989

[54] CLOTHING ARTICLE PACKAGING MACHINE

[75] Inventor: Wilfried Pavel, Halle/Westf., Fed. Rep. of Germany

[73] Assignee: Wilfreid Pavel Machinenbau, Halle/Westf., Fed. Rep. of Germany

[21] Appl. No.: 95,099

[22] Filed: Sep. 10, 1987

[51] Int. Cl.[4] ..... B65B 9/12; B65B 5/02

[52] U.S. Cl. ..... 53/241; 53/256

[58] Field of Search ..... 53/241, 256, 372; 198/465.4, 468.6, 485.1, 486.1, 680

[56] References Cited

U.S. PATENT DOCUMENTS

| | | | |
|---|---|---|---|
| 3,112,586 | 12/1963 | Luetzow | 53/256 |
| 3,895,480 | 7/1975 | Lombardo | 53/256 |
| 4,018,327 | 4/1977 | Goodman et al. | 198/465.4 |
| 4,213,284 | 7/1980 | Silverman et al. | 53/256 |
| 4,233,797 | 11/1980 | Schwarz | 53/241 |
| 4,264,395 | 4/1981 | Tota et al. | 53/241 |
| 4,324,087 | 4/1982 | Mitchell et al. | 53/256 |
| 4,341,583 | 7/1982 | Schwarz | 53/256 |

FOREIGN PATENT DOCUMENTS

| | | | |
|---|---|---|---|
| 1227833 | 10/1966 | Fed. Rep. of Germany | 198/680 |

*Primary Examiner*—Robert L. Spruill
*Assistant Examiner*—Beth Tenney
*Attorney, Agent, or Firm*—Workman, Nydegger & Jensen

[57] ABSTRACT

A packaging machine for packaging clothing articles in a packaging portion of a hose-shaped synthetic plastic material foil includes a machine frame on which a roll of the synthetic plastic material foil is rotatably mounted. The foil unwound from the roll is guided by diverting rollers along a predetermined path to an upper region of the machine frame. An opening device opens the hose-shaped foil at the upper region of the machine frame. An upper welding device welds the foil at the upper region of the machine frame along a predetermined imaginary line situated between the packaging portion and the remainder of the foil with attendant formation of an upper welding seam at which the packaging portion is dissociated from the foil remainder foil. A pulling device pulls the opened hose-shaped foil downwardly over the clothing article to be packaged and includes a foil-pulling carriage guided on the machine frame for vertical displacement, and a motor which displaces the carriage. There is further provided a lower welding device mounted on the carriage for joint movement and welding the packaging portion of the foil after it has been pulled all the way over the clothing article being packaged, at a location disposed downwardly of the clothing article, with attendant formation of a lower welding seam.

18 Claims, 5 Drawing Sheets

I+I

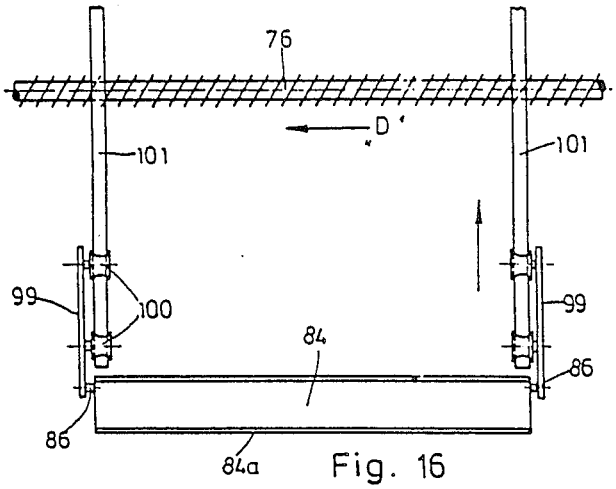
Fig. 16
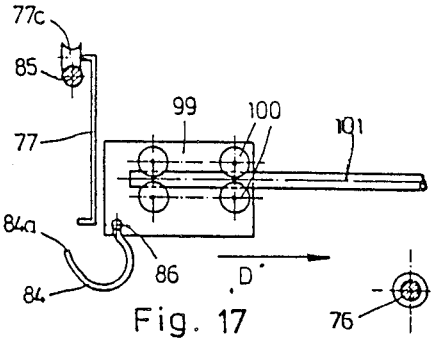
Fig. 17
Fig. 18
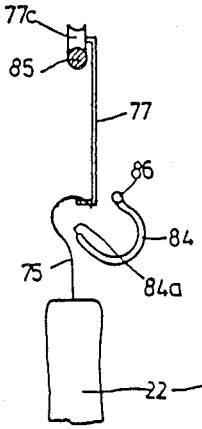
Fig. 19
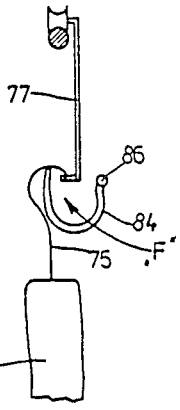
Fig. 20
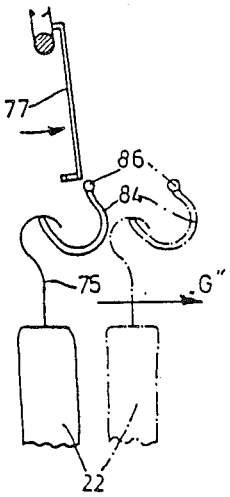
Fig. 21
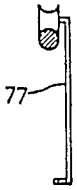
Fig. 22
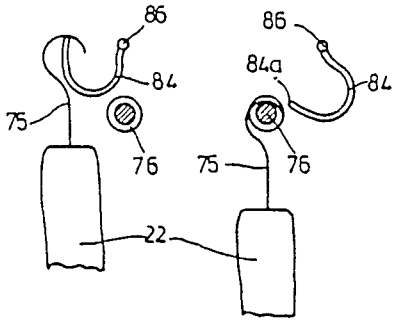

CLOTHING ARTICLE PACKAGING MACHINE

BACKGROUND OF THE INVENTION

The present invention relates to packaging arrangements in general, and more particularly to a packaging machine for packaging clothing articles hanging on clothes hangers in a packaging portion of a synthetic plastic material foil that is pulled over the respective clothing article.

There are already known various constructions of packaging machines for clothing articles, among them such in which a hose-shaped synthetic plastic material foil is pulled over the article to be packaged, and is closed by a transverse welding seam above the upper region of the clothing article. When it is desired to close the packaging portion produced in a packaging machine of such known type even at its lower region by a corresponding welding seam, the clothing article surrounded by the packaging portion has to be taken out of the packaging machine and transported to an auxiliary apparatus which is capable of producing the lower seam. This means that, in order to obtain faultless packaging, there must ordinarily be performed two separate operations that follow one another. This adversely affects the economy of the packaging process, due to the need for the provision of the auxiliary apparatus and the additional time expenditure.

SUMMARY OF THE INVENTION

Accordingly, it is a general object of the present invention to avoid the disadvantages of the prior art.

More particularly, it is an object of the present invention to provide a packaging machine for clothing articles which does not possess the drawbacks of the known machines of this type.

Still another object of the present invention is to devise a packaging machine of the type here under consideration which is capable of closing the packaging foil portion during the same processing operation both at its upper and its lower ends by respective welding seams.

It is yet another object of the present invention to design the above packaging machine in such a manner that the upper end of the packaging foil portion conformingly fits the shoulder regions of the clothing article hanging on a clothes hanger and that triangular excess zones of the foil obtained in the process are automatically removed.

An additional object of the present invention is to develop a transfer arrangement for use in conjunction with the packaging machine of the above type for transferring the clothing articles between a supply screw conveyor and a displaceable receiving carrier.

A concomitant object of the present invention is so to construct the packaging machine and accessories of the above type as to be relatively simple in construction, inexpensive to manufacture, easy to use, and yet reliable in operation.

In keeping with these objects and others which will become apparent hereafter, one feature of the present invention resides in a packaging machine for packaging objects, especially clothing articles, in a packaging portion of a hose-shaped synthetic plastic material foil that is contained on a roll. This packaging machine includes a machine frame; means for rotatably mounting the roll of the synthetic plastic material foil on the machine frame; means for guiding the foil unwound from the roll along a predetermined path to an upper region of the machine frame, including diverting rollers engaging the unwound foil; means for opening the hose-shaped foil at the upper region of the machine frame; means for welding the foil at the upper region of the machine frame along a predetermined imaginary line situated between the packaging portion and the remainder of the foil with attendant formation of an upper welding seam, and for dissociating the packaging portion at the upper welding seam from the remainder of the foil; means for pulling the opened hose-shaped foil downwardly over the clothing article to be packaged, including a foil-pulling carriage guided on the machine frame for up-and-down displacement, and means including a motor for upwardly and downwardly displacing the carriage; and lower welding means mounted on the carriage for joint movement therewith and operative for welding the packaging portion of the foil after it has been pulled all the way over the clothing article being packaged, at a location disposed downwardly of the clothing article, with attendant formation of lower welding seam.

The packaging machine as described so far, which works with a hose-shaped foil for packaging clothing articles, renders it possible, in an advantageous and especially in a very economical manner, to surround the clothing article with the packaging portion of the foil and to weld this packaging portion both at its upper and its lower region by respective welding seams, all in a single operation. In other words, the clothing article is completely packaged during its presence in a single packaging machine and, contrary to what was customary heretofore, need not be transferred to any further auxiliary apparatus for the production of the lower seam.

It may also be seen from the above that, in order to achieve the above-mentioned economical operation, the packaging machine includes a pull-over carriage which also carries a lower welding device, so that this device forms with the carriage a pull-over and lower welding arrangement which is vertically displaceable. Thus, in addition to the pulling-over function, this arrangement also performs, at the close of the pulling-over operation, the lower welding seam fabricating operation. As a result of the integration of the lower welding device with the pull-over carriage, there was obtained in an extremely simple manner a significantly improved operation and effectiveness of the packaging machine. This is so because the packaging machine of the present invention is capable of performing the entire packaging operation in the course of a single processing step, without re-hanging or transfer of the clothing article, and since both time expenditure attendant to such re-hanging or transfer and capital investment relating to the now no longer needed additional auxiliary welding apparatus are reduced. Obviously, this results in an improved economy and effectiveness of the packaging machine and its operation.

The carriage advantageously includes two lateral shields and the additional welding means includes two welding beams, means including mounting arms for mounting the welding beams on the lateral shields of the carriage for movement together and apart with respect to one another, and means for moving the welding beams together and apart relative to one another. The mounting means may include at least one pivoting axle which mounts at least one of the welding beams on the carriage for pivoting movement toward and away from the other of the welding beams. The aforementioned moving means advantageously includes at least one pressurized medium operated cylinder-and-piston unit pivotally mounted on the carriage and acting on one of the mounting arms. It is further advantageous when the carriage further includes a plurality of rods connecting the lateral shields and holding them at a predetermined distance from one another, and when the opening means includes two pliers-like transversely movable grippers mounted on the carriage and each including two pliers elements pivotable together and apart with respect to each other, the grippers being situated between the welding beams and underneath the latter when in their closed position, the opening means further including additional moving means for moving the pliers elements of the grippers together and apart relative to one another, the additional moving means being articulately mounted on the rods and operatively connected with the pliers elements.

According to another advantageous aspect of the present invention, the machine frame includes hollow upright guides, the carriage includes lateral guiding elements which guide the carriage in the hollow upright guides for the up-and-down displacement, and the displacing means further includes elongated flexible displacing elements accommodated in the hollow upright guides, moved by the motor, and connected with the carriage. In this context, it is advantageous when the flexible displacing elements are chains. The machine frame may include upright guides, and control means may be mounted on one of the guides and control the displacement of the carriage in dependence on the shape of the clothing article being packaged. Such controlling means may include at least one photocell device which scans the respective clothing article.

In accordance with another feature of the present invention, auxiliary welding means are arranged at the welding means being operative for producing at least one auxiliary welding and separating seam extending along a substantially inverted-V-shaped course corresponding to respective shoulder regions of the article being packaged at such shoulder regions for separating respective triangular regions of the hose-shaped foil that extend beyond the shoulder regions from the remainder of the packaging portion, and suction means situated at a distance from the auxiliary welding means and operative for removing the triangular regions. Advantageously, the welding means includes two horizontal welding beams which cooperate with one another to produce the upper welding seam, and the auxiliary welding means includes two separate auxiliary welding beams on each of the welding beams and each extending at a distance from the respective other auxiliary welding beam downwardly and outwardly along the inverted-V-shaped course, at least those of the auxiliary welding beams which are mounted on one of the welding beams including a welding strip for producing the auxiliary welding seam, and a welding wire extending parallel to the welding strip at a small distance therefrom and operative for severing the respective triangular regions from the remainder of the packaging portion, each of the welding strips and welding wires extending along the entire length of the associated shoulder region. The aforementioned suction means includes a suction nozzle for each triangular zone bounded by the welding beam and one of the auxiliary welding beams mounted thereon, holding means for releasably holding the suction nozzle at the associated one of the triangular zones, and a discharge conduit connected to the suction nozzle and leading to a collecting receptacle for the triangular regions dissociated from the packaring portion. The holding means may include an insertion sleeve adapted to receive the suction nozzle, and means for retaining the suction nozzle in the insertion sleeve. The suction nozzle advantageously includes a suction pipe, a sleeve-shaped nozzle head which adjoins the suction pipe and is enlarged relative thereto, a connecting nipple for a pressurized air supply provided at the exterior of the nozzle head, a sleeve-shaped control insert accommodated in the nozzle head and having a suction channel therein, a connecting sleeve threadedly connected to an end of the nozzle head which is remote from the suction pipe, fixedly holding the control insert in position in the nozzle head, and connected to the discharge conduit, and sealing means for sealing the interfaces between the control insert, the suction pipe, and the nozzle head. It is particularly advantageous for the control insert to bound a circumferentially extending air distribution chamber which is stepped and is closed in cross section by the nozzle head, for the pressurized air connecting nipple to open into the air distribution chamber at an inclination and oppositely to a suction direction, for the air distribution chamber to be delimited at an end thereof which is closer to the suction pipe by a transversely extending impact surface that deflects the flow of the pressurized air entering the air distribution chamber through the pressurized air connecting nipple, and for the air distribution chamber to be delimited at its other end by a transverse wall which is provided with a plurality of circumferentially distributed jet orifices which open into an enlarged portion of the suction channel of the control insert at an inclination in the suction direction and also in the circumferential direction. It is also advantageous when the suction pipe bounds a suction passage having the same diameter as an adjacent portion of the suction channel of the control insert that extends over a part of the total length of the control insert, whereas the enlarged portion of the suction channel of the control insert has a diameter enlarged with respect to that of the adjacent portion, and when the connecting sleeve has a suction passage which steplessly adjoins the enlarged portion of the suction channel of the control insert and conically diverges in the direction toward the discharging hose.

As a result of the provision of the packaging machine with the auxiliary welding and dissociating means and with the suction arrangement, there has been obtained in a simpler and more reliable manner than before, and automatically, the production of the upper closing zone of the packaging foil portion that conforms in its shape to the collar or neck and shoulder regions of the clothing article being packaged. On the other hand, the projecting, unnecessary triangles of the hose-shaped foil are removed.

According to another facet of the present invention, there is further provided means for transporting the clothing articles hanging on clothes hangers having respective hooks, including a supply screw conveyor, a displaceable receiving carrier including a carrier beam, and means for transferring the clothing articles suspended by the hooks of their hangers from the supply screw conveyor to the receiving carrier, including a transfer guide which receives the clothing articles in their suspended positions from the supply screw conveyor, is pivotable up and down about a horizontally and inclinedly extending pivoting axle, and transfers the clothing articles to the receiving carrier in such a manner that the hooks of their hangers engage and extend over and partially around the carrier beam. Advantageously, the transfer guide includes a supporting edge portion for supporting the hooks of the clothes hangers, the supporting edge portion being inclined downwardly in an advancement direction of the clothing articles, being situated in its clothing article receiving position at a lower elevation than the carrier beam, and being mounted for tilting around and above the carrier beam for the transfer of the clothing articles to the latter; wherein the transfer guide has a cross-sectionally U-shaped configuration bounding a receiving channel and including front and rear arms, of which the front arm constitutes the supporting edge portion; and further comprising an auxiliary support, a holding device mounted on the auxiliary support, and a pivoting axle mounting the rear one of the arms of the transfer guide on the holding device for pivoting thereabout.

The packaging machine advantageously further comprises first and second pressurized medium operated cylinder-and-piston units each articulately mounted on the holding device and including a piston rod, means for connecting the piston rod of the first cylinder-and-piston unit with the transfer guide for pivotally displacing the latter in response to movement of the piston rod, and at least one pusher mounted on the holding device for pivoting relative thereto and for displacement relative to the receiving carrier and connected to the piston rod of the second cylinder-and-piston unit for so pivotally displacing the receiving carrier oppositely to the pivoting direction of the transfer guide in response to movement of the piston rod of the second cylinder-and-piston unit that the carrier beam of the receiving carrier is introduced into the receiving channel of the transfer guide. The receiving carrier may further include at least one connecting beam. Then, there may be further provided an additional pusher similar to the one pusher, the pushers acting on the connecting beam of the receiving carrier. Furthermore, there may be provided a horizontal pivoting axle supported on the holding device, two rocking levers each mounting one of the pushers on the horizontal pivoting axle, a transverse reinforcing rod rigidly connecting the pushers with one another, and an additional rocking lever connecting the reinforcing rod with the piston rod of the second cylinder-and-piston unit. The holding device advantageously includes two U-shaped frames having respective downwardly oriented front and rear arms and the transfer guide is mounted on the rear arms of the U-shaped frames, whilr the at least one pusher is mounted on the front arms of the U-shaped frames. The pusher may be constructed as a roller and may be of rubber, synthetic plastic material, and the like.

It is also advantageous when, in accordance with the present invention, there is provided an auxiliary support, when the supply screw conveyor includes a supply screw, a bearing guide mounting the supply screw on the auxiliary support for rotation about a longitudinal axis thereof, and a motor driving the supply screw in rotation, and when there are further provided two abutment members mounted on the bearing guide at a predetermined distance from one another in the longitudinal direction of the supply screw for movement between extended positions in which they delimit a receiving zone for a number of the clothing articles to be transferred and prevent passage of the clothing articles on the supply screw past them, and retracted positions in which they allow such passage, and means for individually moving each of the abutments between its extended and its retracted positions. The moving means may include a separate pressurized medium operated cylinder-and-piston unit for each of the abutments, the unit having a piston rod constituting the abutment, or a separate lifting magnet unit for each of the abutments, this unit then having a tappet constituting the abutment.

There may be further provided means for lifting the hooks of the clothes hangers on which the clothing articles hang off from the supply screw conveyor, including a ramp surface that is upwardly inclined a considered in the advancement direction of the clothing articles on the supply screw, and sliding rod mounted on the auxiliary support and extending from a downstream end of the ramp surface to an upstream end of the transfer guide along a course which is downwardly inclined in the clothing article advancement direction. The ramp surface follows a path which is substantially straight or arcuate path, while the course of the sliding rod is substantially straight or arcuate.

The present invention also provides for the packaging machine to further comprise an auxiliary support, means including rollers for displaceably supporting the receiving carrier, abutment means mounted on the auxiliary support for movement between retracted and extended positions thereof in which they are situated out of and in the path of movement of the rollers, respectively, and operative in the extended position thereof for fixing the receiving carrier in its transfer position. The packaging machine may and further comprise means for guiding the transfer guide for movement transversely to the advancement direction of the clothing articles between the receiving carrier and the supply screw conveyor. Such guiding means may advantageously include guiding rods, and at least one support carriage supporting the transfer guide and supported on the guiding rods for movement longitudinally thereof.

The provision of the transfer arrangement or transporting means renders it possible, in a simple and reliable manner, to achieve transfer of clothing articles which hang on clothes hangers from a supply screw conveyor to a receiving carrier which may be of a type that is a commercially available in many implementations.

This transfer is accomplished in each instance automatically and in a manner which is electrically and electronically controlled. During this transfer operation, a plurality and more particularly a predetermined number of the clothing articles is in each instance simultaneously supplied to the transfer arrangement and transferred by the latter to the receiving carrier. As a result of the advantageous pivoting movements of the transfer guide and of the receiving carrier, it has been accomplished that the transfer of the clothing articles can reliably take place over a very small distance.

BRIEF DESCRIPTION OF THE DRAWING

The present invention will be described below in more detail with reference to the accompanying drawing in which:

FIG. 16 is a top plan view of a transfer arrangement which is displaceable transversely with respect to a supply screw conveyor;

FIG. 17 is a diagrammatic side elevational view of the transfer arrangement of FIG. 16; and FIGS. 18 to 22 are diagrammatic views depicting the transfer process from the receiving carrier to the supply screw conveyor.

DETAILED DESCRIPTION OF THE PREFERRED EMBODIMENT

Figure 1:
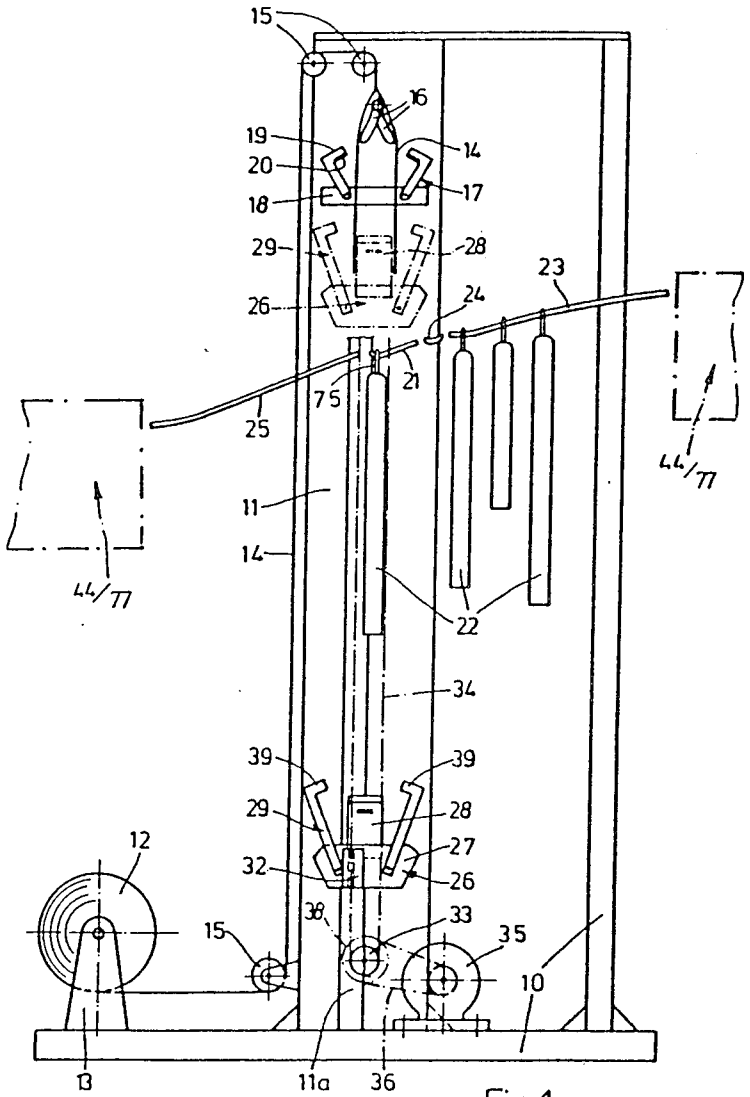
FIG. 1 is a diagrammatic side elevational view of a packaging machine of the present invention.

Referring now to the drawing in detail, and first to FIG. 1 thereof, it may be seen that the reference numeral 10 has been used therein to identify a machine frame of a packaging machine constructed in accordance with the present invention. The machine frame 10 includes two upright guides 11 which are arranged next to one another. A foil roll 12 is rotatably and exchangeably mounted on the machine frame 10 or on the guides 11 in holding arrangements 13. A hose-shaped foil 14 of synthetic plastic material is being withdrawn from the foil roll 12 and is guided over deflecting rollers 15 to the upper region of the guides 11.

At the upper region of the machine frame 10, that is, at the upper region between the guides 11, there is arranged an opening device 16, for instance, in the form of spreading spoon-shaped elements or the like, which opens up and holds open the hose-shaped foil 14 that arrives thereto in its flat or collapsed state.

At the region of this opening device 16, there is situated between the guides 11 a stationary welding and cutting device 17 which is operative for making an upper packaging welding seam 48 and for separating of the portion of the hose-shaped foil 14 that is needed for the packaging from the remainder of the hose-shaped foil 14. This welding and cutting device 17 includes, mounted on a holding device 18 that is supported on the guides 11, two welding beams 19 carrying associated cutting blades 20, extending over the entire width of the hose-shaped foil 14, and movable toward and away from one another.

Underneath this welding and cutting device 17, there is disposed on the machine frame 10 a suspension arrangement 21 for a clothing article 22 to be packaged, wherein the hose-shaped foil 14 is pulled over this suspended clothing article 22 along a vertical plane from above to below. The clothing articles 22 are introduced into the machine frame 10 transversely to the plane of the hose-shaped foil 14 and are transferred to the suspension arrangement 21 by means of a supplying device 23 which is mounted on the machine frame 10 and is constituted, for instance, by a supply screw, and by means of an individualizing device 24 which is situated between the individualizing device and the suspension arrangement 21. A discharging arrangement 25, such as a rod, screw or the like, is associated with the suspension arrangement 21 and is operative for transporting the packaged clothing article 22 out of the machine at a side of the latter which is disposed oppositely to that at which the supplying device 23 is located.

Between the guides 11, there is disposed a lower welding arrangement 26 of the present invention for up and down movement. The lower welding arrangement 26 is constituted by a foil pull-over carriage 27 provided with grippers 28, and by a welding device 29 and is operative for forming a lower packaging welding seam 49.

The foil pull-over carriage 27 includes two lateral shields 31 which are held at a predetermined distance from one another by connecting rods 30, and on the outer side of each of which there is secured a T-shaped guiding element 32. The foil pull-over carriage 27 is mounted by means of these T-shaped guiding elements 32 on the guides 11 for up and down movement. In a currently preferred embodiment, the guides 11 are constituted by hollow profiled sections each having a groove 11*a* which opens toward the respective one of the lateral shields 31 and into which a T-shaped web 32*a* of the respective T-shaped guiding element 32 penetrates and engages. The T-shaped guiding element 32 itself is slidably guided in the hollow guides 11 during the upward and downward movement of the foil pull-over carriage 27.

For the up-and-down movement of the foil pull-over carriage 27, one run of an endless chain 34, which is trained about respective reversing rollers 33 that are rotatably mounted at the upper and lower end regions of the guides 11, engages each of the T-shaped guiding element 32, so that an up-and-down movement of the foil pull-over carriage 27 and thus of the entire lower welding arrangement 26 occurs as a result of the action of the two chains 34.

A driving motor 35, such as an electric motor, is supported on the lower portion of the machine frame 10. The driving motor 35 drives, by means of an embracing drive 36, preferably a chain drive, a shaft 37 which connects the two lower reversing rollers 33 for joint rotation, in that the embracing drive 36 is in engagement with a wheel 38 which is mounted for joint rotation on the shaft 37.

Instead of the two chains 34, there may also be used other embracing drives, such as toothed belts or the like, or a motor-driven threaded spindle, such as ball roller spindle, a toothed rack drive, or the like, can be used for the accomplishment of the up-and-down movement of the lower welding arrangement 26.

The welding device 29 includes two welding beams 39 that extend over the entire width of the hose-shaped foil 14 and which are provided at their respective ends with respective carrying arms 40 that support the welding beams 39 on the lateral shields 31. Herein, at least one of the welding beams 39 is mounted for movement relative to the other one. Preferably, however, both of the welding beams 39 are so constructed and mounted as to be movable toward and away from one another, in that the carrying arms 40 are mounted for pivoting on the connecting rods 30 which thus simultaneously constitute pivoting axles for the carrying arms 40. As a result, the two welding beams 39 are pivoted toward each other each about its respective horizontal pivoting axle 30 for the production of the welding seam, and then again pivoted away from one another after the completion of the production of the welding seam.

Figure 2:
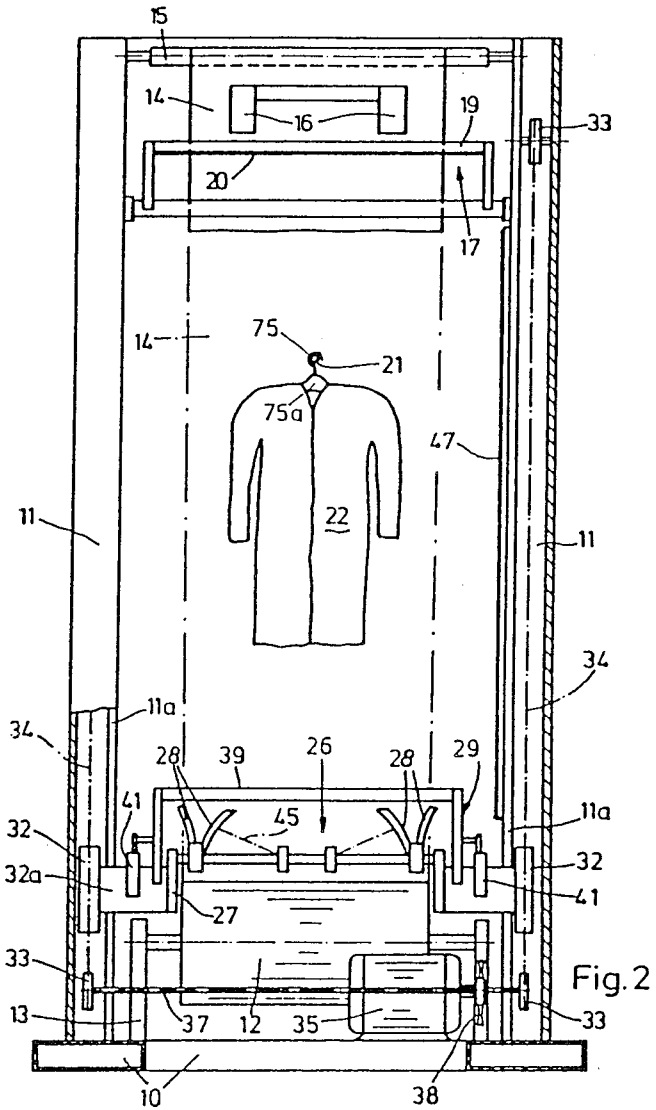
FIG. 2 is a diagrammatic partially sectioned front elevational view of the machine of FIG. 1.
Figure 3:
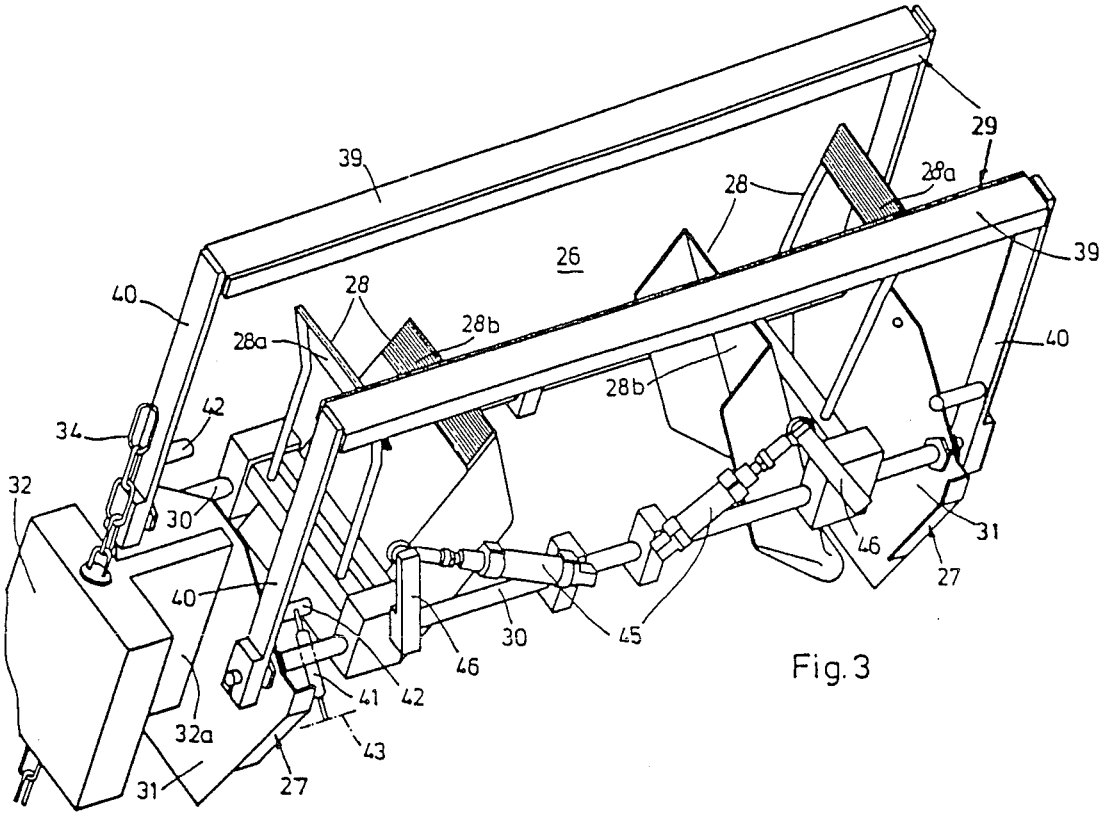
FIG. 3 is a perspective view of a lower welding arrangement employed in the packaging machine of FIG. 1.

The pivoting movement of the two welding beams 39 is preferably accomplished by means of a pressurized medium operated cylinder-and-piston unit 41. The pressurized medium operated cylinder-and-piston unit 41 includes a piston rod which is articulated to projections 42 of the carrying arms 40, and a cylinder housing which is pivotally mounted about an axle 43 either on the lateral shields 31 as shown in FIG. 3, or on the T-shaped guiding elements 32 as shown in FIG. 2 of the drawing.

The grippers 28 are mounted on the connecting rods 30 in such a manner as to be spaced from one another in the longitudinal direction of the connecting rods 30 and they engage the opened hose-shaped foil 14 at its width end regions. The grippers 28 are situated between the welding beams 39 and, in the closed position of the welding beams 39, are disposed at a distance underneath the welding beams 39.

Each of the two grippers 28 consists of two plier-like parts or spoon-shaped members **28*a* and 28*b* which are movable together and apart with respect to one another. Of these spoon-shaped members 28*a* and 28*b*, one is stationary and the other is movable with respect to the stationary one, preferably pivotally movable. However, both of the spoon-shaped members 28*a* and 28*b* could be pivotable about a common axis or each about its own pivoting axis (n) which would be horizontal and extend transversely to the pivoting axle 30 of the welding beam 39 into its closed gripping position and into its open position in which the spoon-shaped members 28*a* and 28*b*** are spread apart.

The pivoting movement for each of the grippers 28 is accomplished by means of a pressurized medium operated cylinder-and-piston unit 45 which is articulated to one of the connecting rods 30 and is connected with the pivoting axles of the spoon-shaped members **28*a* and 28*b* or directly with the spoon-shaped members 28*a* and 28*b* by means of levers 46** or the like.

The lower welding arrangement 26 is movable from its lower initial position in which it is located underneath the longest possible one of the suspended clothing articles 22 upwardly all the way up to the clothing article suspension arrangement 21. In this upper position, the lower welding arrangement 26 is disposed immediately below the upper welding and cutting device 17 or partially penetrates into the latter.

Having so described the construction of the packaging machine of the present invention, the operation thereof for achieving packaging of a clothing article 22 will now be explained with reference to FIGS. 4 to 8 of the drawing which diagrammatically illustrate successive operating steps of such packaging operation.

Prior to the introduction of the clothing article 22 to be packaged into the packaging machine, the lower welding arrangement 26 is displaced upwardly into its uppermost position in which it is situated underneath the suspension arrangement 21. Then, one of the clothing articles 22, which are stored by the supplying device 23 in that they are suspended by hooks 75 of respective clothes hangers **75*a* on which they hang from the supplying device 23, is supplied by the individualizing device 24 to the suspension arrangement 21** in such a manner that it is situated in its hanging packaging position.

The hose-shaped foil 14 which is unwound from the foil roll 12 is opened by the upper opening device 16 and is being held open as a packaging hose. The two welding beams 19 of the upper welding and cutting device 17 are swung away from one another into their open position, as indicated in FIG. 4 of the drawing.

Figures 4, 5, 6, 7, 8:
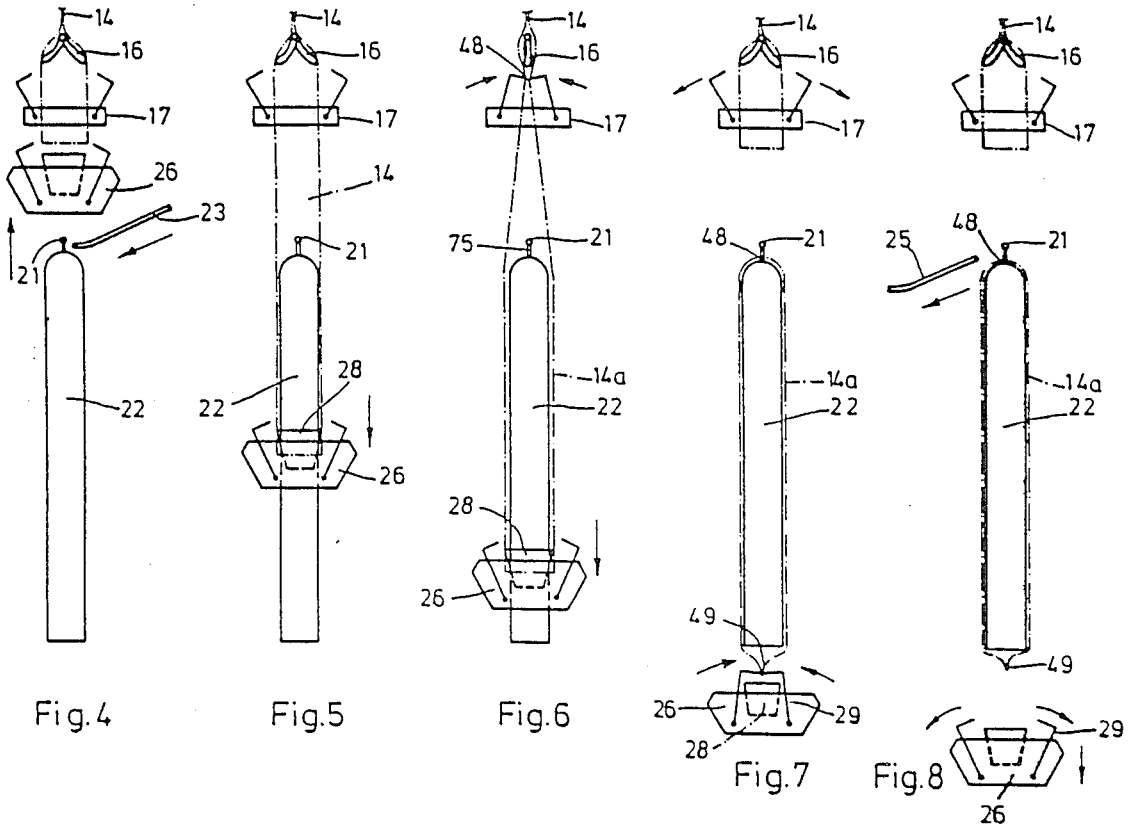
FIGS. 4 to 8 are diagrammatic side elevational views of the machine of FIG. 1 during different phases of operation.

The two welding beams 39 of the lower welding arrangement 26 are also positioned in the upwardly displaced position of the lower welding arrangement 26 in their swung-apart open position, as also indicated in FIG. 4 of the drawing.

The two grippers 28 of the lower welding arrangement 26 now engage the held-open hose-shaped foil 14, are pivotally displaced toward one another and firmly hold the hose-shaped foil 14 at mutually opposite locations in its open hose configuration. Then, the lower welding arrangement 26 is displaced downwardly over the clothing article 22, wherein the swung-apart welding beams 39 ar disposed at two opposite sides of the clothing article 22, and more particularly at the wide sides of the clothing article 22, while the two welding devices 29 are also situated at two opposite sides of the clothing article 22, and more particularly at the narrow sides of the clothing article 22, so that the lower welding arrangement 26 is able to be displaced downwardly over the clothing article 22 without touching the latter. As a result of this downward displacement of the lower welding arrangement 26, the hose-shaped foil 14 which is entrained by the gripper 28 for joint movement therewith, is pulled over the clothing article 22, as indicated in FIG. 5 of the drawing.

After the performance of a certain downward movement which is not yet sufficient for the lower welding arrangement 26 to have fully moved downwardly past the clothing article 22 and below the latter, so that the lower welding arrangement 26 is still situated around the clothing article 22, the downward movement of the lower welding arrangement 26 is interrupted. At this time, there is performed the welding of the upper packaging welding seam 48 and the separation of a hose-shaped foil portion **14*a* which has been withdrawn from the foil roll 12 and which constitutes the packaging means from the hose-shaped foil 14 by the upper welding and cutting device 17. The packaging welding seam 48 is produced by swinging the welding beams 19 together. Simultaneously therewith, there is accomplished the separation of the hose-shaped foil portion 14*a* from the hose-shaped foil 14 by the cutting blades 20 which are arranged on the welding beams 19, as indicated in FIG. 6** of the drawing.

At this time, the upper packaging welding seam 48 is situated at a distance upwardly of the shoulder region of the clothing article 22, as also indicated in FIG. 6 of the drawing.

After the completion of this operating step, the downward movement of the lower welding arrangement 26 is resumed and continues until the lower welding arrangement 26 is situated below the lower edge of the clothing article 22. During this continued downward movement of the lower welding arrangement 26, the hose-shaped foil portion **14*a* is also being displaced downwardly, so that eventually the upper packaging welding seam 48 comes to rest on the shoulder region of the clothing article 22 and the clothing article 22 is surrounded by the hose-shaped foil portion 14***a* over its entire height, as indicated in FIG. 7 of the drawing. At this time, the grippers 28 release the lower end of the hose-shaped foil portion 14*a* by being swung apart and the welding beams 39 are pivoted toward one another in order to produce the lower packaging welding seam 49, as so indicated in FIG. 7 of the drawing.

Subsequently to this operating step, the welding beams 39 are pivoted apart from one another and the lower welding arrangement 26 is moved still further downwardly by a small distance to release the completely packaged clothing article 22 which is completely surrounded by the hose-shaped foil portion 14*a* and which is sealingly enclosed in the hose-shaped foil portion 14*a* by the respective packaging welding seams 48 and 49, so that the packaged clothing article 22 can be transported out of the packaging machine by the discharging arrangement 25, as indicated in FIG. 8 of the drawing.

Thereafter, the lower welding arrangement 26 is again moved upwardly into its upper position illustrated in FIG. 4 of the drawing, and a new packaging operation can commence.

The up-and-down movement of the lower welding arrangement 26 into its uppermost position according to FIG. 4, into the partially downwardly displaced position according to FIG. 6, into the lower welding position according to FIG. 7, and into the lowermost position according to FIG. 8 in which the lower welding arrangement 26 releases the packaged clothing article 22, is controlled by an electrical and/or electronic control arrangement 47. The control arrangement 47 is mounted on the machine frame 10, preferably on one of the lateral guides 11. The control arrangement 47 may control the movements in response to signals received from photoelectric cells or similar devices which scan or sense the clothing article 22. In correspondence with this control of the displacement of the lower welding arrangement 26, there is then also accomplished a control of the welding and cutting operation performed by the upper welding and cutting device 17 and the grippers 28, and by the lower welding device 29. In this manner, there is obtained an automatic operation of the packaging machine.

In this packaging machine according to the present invention, it is also possible to accomplish simultaneous packaging of two or more of the clothing articles 22 which are held next to one another in the suspension arrangement 21 by a single hose-shaped foil 14.

It is provided in this packaging machine according to the present invention that the welding device 29 of the lower welding arrangement 26 is put out of operation by means of a switch which is connected with the control arrangement 47, so that this welding device 29 becomes ineffective and only the foil pull-over carriage 27 and the grippers 28 of the lower welding arrangement 26 are being used for the pulling of the hose-shaped foil 14 over the clothing article 22.

The welding and cutting device 17 and the welding device 29 can be so constructed that they are capable of producing either a horizontal, or an inclinedly extending, or a profiled packaging welding seam 48 or 49, respectively.

Figure 9:
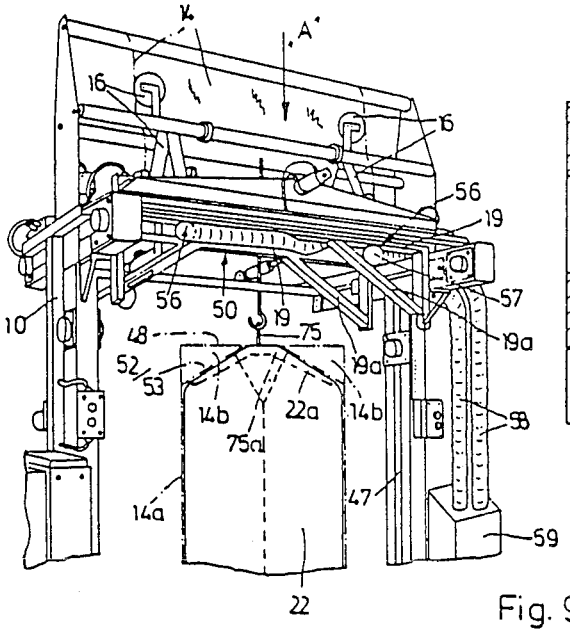
FIG. 9 is a perspective view of an upper region of the packaging machine similar to that of FIG. 1 but equipped for removing triangular foil regions from the packaging foil portion at the shoulder regions of the clothing article.
Figure 10:
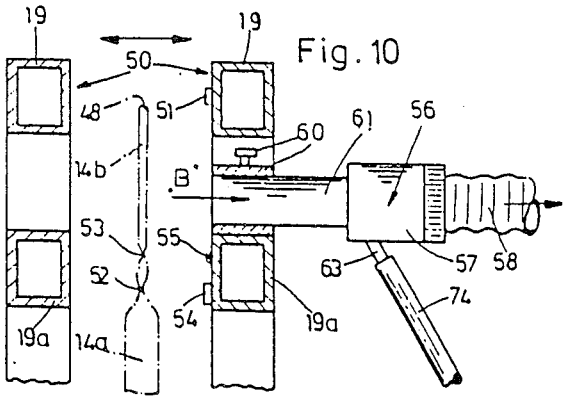
FIG. 10 is a vertical sectional view through the packaging machine of FIG. 9.

As shown in FIG. 9 of the drawing, a welding and separating device 50 is arranged at an upper region of the machine frame 10 downstream of the hose-shaped foil opening device 16. The welding and separating device 50 produces an upper packaging welding seam 48 which extends at an inclination with respect to a withdrawal direction "A" of the hose-shaped foil 14. The welding and separating device 50 also simultaneously separates the portion 14*a* of the hose-shaped foil 14 that is withdrawn from the foil roll 12 and that is pulled over the clothing article 22 from the remainder of the hose-shaped foil 14 that is being dispensed from the foil roll 12.

This welding and separating device 50 is preferably constituted by two welding beams 19 which are movable toward and away from one another and which between themselves carry a welding and separating wire 51 that produces the transversely extending packaging welding seam 48. These two welding beams 19 are mounted on the machine frame 10 also for a certain amount of vertical displacement.

At the welding and separating device 50, there are arranged at a distance next to one another two welding and separating elements 54 and 55 each of which is operative for providing an inclinedly extending welding and separating seam 52 or 53, which together extend along an inverted V-shaped course in correspondence with shoulder regions 22*a* of the respective clothing article 22 that are being held in inclinedly falling positions, in a respective hose-shaped foil triangle 14*b* of the hose-shaped foil 14 that is situated above the respective shoulder region 22*a*, close to and parallel to the respective shoulder region 22*a*, as well as a suction device 56 for each of the hose-shaped foil triangles 14*b*.

The welding and separating wire 51 for the transversely extending packaging welding seam 48 is mounted on one of the horizontally extending welding beams 19 which cooperate with the oppositely located, horizontally extending other welding beam 19 and produces the transversely extending packaging welding seam 48 over the entire width of the hose-shaped foil 14.

Each of the two welding and separating elements 54 and 55 is mounted on an inclined welding beam 19*a*. The welding beams 19*a* are mounted below the horizontal welding beams 19 and extend there at a distance from the center (clothing article suspension) inclinedly downwardly as considered in the outward directions in correspondence with the respective shoulder regions 22*a*, so that they follow a course which has, for all intents and purposes, an inverted V-shaped configuration. Each of these welding beams 19*a* also cooperates with a corresponding opposing welding beam 19*a* which is mounted on the respective other welding beam 19.

The welding member 54 is constituted by a welding strip which produces, parallel to the shoulder region 22*a*, the inclinedly extending welding and separating seam 52 in the hose-shaped foil 14 to sealingly weld the latter. The separating member 55 is constituted by a welding wire which extends parallel to and at a distance form the welding member 54 and which weldingly dissociates the sealingly welded hose-shaped foil 14 at a small distance from the welding and separating seam 52 along the inclinedly extending welding and separating seam 53, so that the hose-shaped foil triangle 14*b* is separated from the hose-shaped foil portion 14*a* which is pulled over the clothing article 22.

In order to be able to transport the separated hose-shaped foil triangles 14*b* away, there are provided the two suction devices 56 on the welding and separating device 50. Each of the suction devices 56 consists of a suction nozzle 57 and a discharge hose 58. Both of the discharge hoses 58 open into a common accumulating receptacle 59.

In each of the two triangular regions bounded by the welding beams 19 and 19*a* of the welding and separating device 50, there is releasably mounted in a holding device 60, such as insertion sleeve with a clamping screw, a suction pipe 61 of the suction nozzle 57, which is arranged on the suction side of the suction nozzle 57 and one end of which faces toward the hose-shaped foil triangle 14*b*. The other end of the suction pipe 61 is connected to the discharge hose 58. The suction pipe 61 of the suction nozzle 57 is widened to form a sleeve-shaped nozzle head 62 on the outside of which there is provided a connecting nipple 63 and within which there is accommodated a sleeve-shaped control insert 64. The end of the sleeve-shaped nozzle head 62 which is remote from the suction pipe 61 is closed by a screwed-in connecting sleeve 65 to which the discharge hose 58 is releasably connected.

Figure 11:
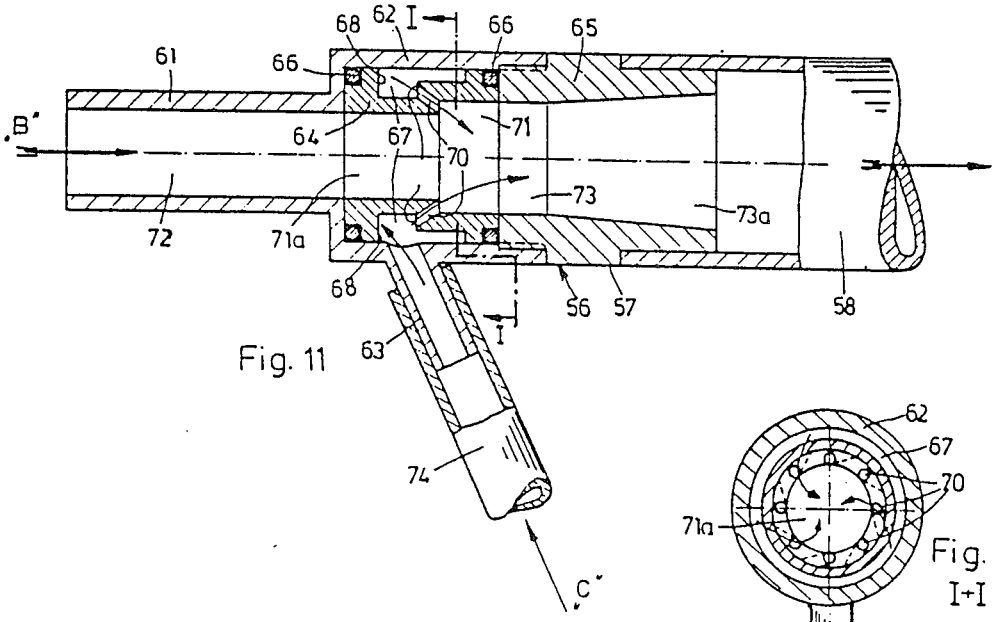
FIG. 11 is a longitudinal sectional view of a suction nozzle employed in the machine of FIG. 9.
Figure 12:
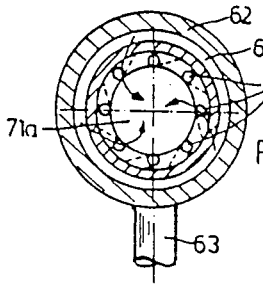
FIG. 12 is a cross-sectional view through the suction nozzle taken on line I—I of FIG. 11.

The sleeve-shaped control insert 64 is sealed in the sleeve-shaped nozzle head 62 with respect to the suction pipe 61 and the connecting sleeve 65 by sealing rings 66 which are received in annular grooves. The sleeve-shaped control insert 64 includes over its circumference a stepped air distribution chamber 67 which is arranged at a distance form the two end faces of the sleeve-shaped control insert 64 and thus from the sealing rings 66. The air distribution chamber 67 is closed in cross section by the surrounding sleeve-shaped nozzle head 62. The connecting nipple 63 opens into the air distribution chamber 67 at an inclination in the direction toward the suction pipe 61. An end face of this air distribution chamber 67 which faces toward the suction pipe 61 constitutes a circumferentially extending impacting surface 68 for the flowing-in pressurized air stream. The air distribution chamber 67 is further provided in a stepped end face 69 which is spaced from the impacting surface 68 in the direction toward the connecting sleeve 65 with a plurality of nozzle orifices 70 which are preferably uniformly distributed over the circumference of the sleeve-shaped control insert 64. The nozzle orifices 70 open into a suction channel 71 of the sleeve-shaped control insert 64 in a suction direction "B" which is inclined with respect to the longitudinal axis of the sleeve-shaped control insert 64. Moreover, these nozzle orifices 70 are also inclined in the circumferential direction of the sleeve-shaped control insert 64, so that the air in the suction channel 71 has a twisting motion imposed thereon. This can be easily ascertained from FIGS. 11 and 12 of the drawing.

The suction pipe 61 forms a suction channel 72 which is adjoined by a suction channel 71*a* having the same diameter and provided in the sleeve-shaped control insert 64. The suction channel 71*a* is then widened at the region of exit of the nozzle orifices 70 by a step to form the suction channel 71. A suction channel 73 having the same diameter as the suction channel 71 and provided in the connecting sleeve 65 then adjoins the suction channel 71. The suction channel 73 then continues into a conically diverging suction channel 73*a* that opens into the discharge hose 58.

A pressurized air supply hose 74 is then releasably connected to the connecting nipple 63.

The removal of the excess, unneeded hose-shaped foil triangles 14*b* is accomplished in the following manner:

After the transversely extending, horizontal packaging welding seam 48 has been produced by the welding beams 19 and, consequently, the hose-shaped foil portion 14*a* which is to be pulled downwardly over the clothing article 22 has been separated from the remainder of the hose-shaped foil 14 that is still connected to the foil roll 12, this hose-shaped foil portion 14*a* which is closed at its upper end is pulled downwardly to such an extent until the transversely extending packaging welding seam 48 comes to rest on the collar region of the clothing article 22. At this time, the hose-shaped foil triangles 14*b* that are not filled by the clothing article 22 project uselessly upwardly beyond the shoulder regions of the clothing article 22. Now, the welding beams 19 and thus also the welding beams 19*a* are once more displaced toward one another and the welding and separating elements 54 and 55 produce the respective welding and separating seams 52 and 53. As a result, the hose-shaped foil portion 14*a* which is pulled over the clothing article 22 is sealingly welded together at its upper region in an inverted V-shaped configuration correspondingly to the shape of the corresponding region of the clothing article 22 and particularly the shoulder regions 22*a*, on the one hand, and the projecting hose-shaped foil triangles 14*b* are separated from the remainder of the hose-shaped foil portion 14*a*, on the other hand.

Shortly before the expiration of the dwell time of the welding beams 19 and 19*a* in their moved-together positions, the suction devices 56 are switched on and supplied with pressurized air. The pressurized air flow brings about a suction effect in the suction nozzles 57. The thus obtained suction air flow captures the respective hose-shaped foil triangles 14*b*. These hose-shaped foil triangles 14*b* are then transported by this suction air flow through the suction channels 72, 71*a*, 71, 73 and 73*a* in the direction of the arrow "B", and then through the discharge hose 58 to the accumulating receptacle 59.

At the time of performance of the movement of the welding beams 19 and 19*a* apart, in the course of which the suction nozzles 57 move together with the welding beams 19 and 19*a*, each of the separated hose-shaped foil triangles 14*b* has already been removed by the suction effect. Thus, a new packaging operation can be commenced immediately thereafter. Even if the quality of the separating seam 53 produced by the separating wires 55 is unsatisfactory, the hose-shaped foil triangles 14*b* will still be removed from the hose-shaped foil 14, as a result of the suction effect produced by the suction nozzles 57.

The pressurized air which enters through the pressurized air connection 63 and 74 into the air distribution chamber 67 in the direction of an arrow "C" at an inclination and oppositely to the subsequent suction direction "B" impinges upon the impacting surface 68 and is diverted by the latter into the direction "B". Then, this air flows under pressure through the nozzle orifices 70 into the suction channel 71, as a result of which suction is created in the suction pipe 61. This suction then results in the aspiration and entrainment of the hose-shaped foil triangle 14*b* for travel through the suction nozzle 57. The initially pressurized air then flows, wile maintaining its suction effect, through the connecting sleeve 65 and the discharge hose 58 and entrains the hose-shaped foil triangle 14*b* for joint travel therewith at a high speed all the way to the accumulating receptacle 59, as may be ascertained from FIGS. 11 and 12.

After each completion of the respective welding and separating seam 52 and 53, and the suction removal of the respective hose-shaped foil triangle 14*b*, the operation of the suction devices 56 is temporarily discontinued, until after a new clothing article 22 has been automatically introduced into the proper position in the packaging machine and the transversely extending packaging welding seam 48 has been produced, as well as after the hose-shaped foil portion 14*a* has been pulled downwardly over the clothing article 22, so that there can be accomplished a new welding operation and a new suction removal of the hose-shaped foil triangles 14*b*.

In FIGS. 13 to 22, there is depicted a transfer arrangement 44. One transfer arrangement 44 of this type is arranged upstream and another downstream of the packaging machine to serves for the supply of the clothing articles into and their removal from the packaging machine, respectively. For an economical performance of the packaging operation, each transfer arrangement 44 is constructed as a constituent component of the complete packaging machine or packaging installation.

The transfer arrangement 44 effectuates the transfer of the clothing articles 22, which are suspended on the clothes hangers 75*a*, from a supply screw conveyor device 76 to a displaceable receiving carrier (carriage) 77, which is also frequently referred-to as a so-called trolley. A certain number of the clothing articles 22 can be supplied to the packaging machine or removed from the latter by means of this receiving carrier 77.

The aforementioned transfer arrangement 44 includes a frame 78 which is either a constituent component of the machine frame 10, or is positioned next to or connected with the machine frame 10.

The supply screw conveyor device 76, which is equipped with a motor drive 79, such as an electric driving motor, which is arranged at one longitudinal end of the supply screw conveyor device 76, is turnably mounted in a rotatable bearing guide 80 in such a manner that its longitudinal axis extends horizontally. The rotatable bearing guide 80 holds the supply screw conveyor device 76 and also the motor drive 79 in position on the frame 78.

The supply screw conveyor device 76 receives the clothing articles 22 in such a manner that the hooks 75 of the clothes hangers 75*a* on which the respective clothing articles 22 hang engage and depend from the supply screw conveyor device 76, and transports the thus suspended clothing articles 22 in a longitudinal direction "D" of the supply screw conveyor device 76. On the rotatable bearing guide 80, there are arranged, at a distance downstream of one another as considered in the longitudinal direction "D" of the supply screw conveyor device 76, two abutments 81, between which the desired number of the clothing articles 22 is assembled on the supply screw conveyor device 76.

Each of the two abutments 81 is preferably constituted by a piston rod (tappet) of a pressurized medium operated cylinder-and-piston unit 81*a* or a lifting magnet which is mounted on the rotatable bearing guide 80. In its stopping position (active position), the respective abutment 81 extends into the path of movement of the clothes hanger hooks 75, so that no advancement movement of the clothing articles 22 occurs even if the supply screw conveyor device 76 rotates so long as the respective abutment 81 is in its stopping position, and the clothing articles 22 remain suspended between the two abutments 81.

A lifting device 82 is further mounted on the rotatable bearing guide 80. The lifting device 82 is situated at a distance behind the rear one of the abutments 80 as considered in the advancement direction "D" and is operative for lifting the clothes hanger hooks 75 from the supply screw conveyor device 76. This lifting device 82 is constituted by an inclined or arcuate ramp track which extends upwardly up to the highest circumferential point of the supply screw conveyor device 76 and, because of this, lifts the clothes hanger hooks 75 which run onto it upwardly from the supply screw conveyor device 76.

The thus lifted-off clothes hanger hooks 75 are then transferred from the lifting device 82 to a sliding rod 83. The sliding rod 83 is so disposed that one of its longitudinal ends is situated at the immediate vicinity of the highest point of the supply screw conveyor device 76, that it then extends along an inclined and/or arcuate course downwardly, and that its other end terminates immediately at a transfer guide 84 which takes over the arriving clothing articles 22 by means of the clothes hanger hooks 75 and then transfers them to the receiving carrier 77.

The receiving carrier 77 is constructed in a known manner in that it has a frame-shaped configuration and includes a beam 77*b* which extends in the supply direction and is arranged at the lower side of the receiving carrier 77 on upright beams 77*a* or chains. The clothes hanger hooks 75 are transferred to the beam 77*b*.

The receiving carrier 77 is provided at its upper side (that is at the region of its beams 77*a* or chains) with rollers 77*c* by means of which it is displaceably supported on a slightly downwardly inclined guiding rail 85 which extends in the advancement direction "D". The guiding rail 85, in turn, is supported on the frame 78.

The transfer guide 84 is preferably constituted by a trough which is part-circular in cross section and has a length that approximately equals the length of the receiving carrier beam 77*b*. However, the transfer guide 84 is preferably somewhat smaller than the beam 77*b* to assure that all of the clothes hanger hooks 75 which arrive on the transfer guide 84 can be safely transferred to the beam 77*b*. One of the longitudinal edge portions of the trough-shaped transfer guide 84 constitutes a carrying edge portion 84*a* for the clothes hanger hooks 75. The sliding rod 83 terminates at one end zone of this carrying edge portion 84*a*.

The other edge portion of the trough-shaped transfer guide 84 is mounted on a support 87 for up-and-down down pivoting about a horizontal or inclined pivoting axle 86. The support 87 is constituted, for instance, by two U-shaped frames of the frame 78 which are arranged at a distance from one another in the advancement direction "A".

The downwardly oriented U-shaped frames constituting the support 87 overlap with spacing the receiving carrier 77 carrying the guiding rail 85. The carrying edge portion 84*a* of the transfer guide 84 is situated frontwardly at the access side of the transfer arrangement 44 and the rear edge portion of the transfer guide 84 is mounted by means of the pivoting axle 86 for up-and-down movement at the lower ends of the rearward legs of the U-shaped frames constituting the support 87. For the pivoting movement of the transfer guide 84, there is provided at least one pressurized medium operated cylinder-and-piston unit 88 which is pivotably mounted on the support 87 and has a 388 88*a* which acts, via a lever linkage or a swivelling lever 89 on the pivoting axle 86 or on the transfer guide 84.

Figure 14:
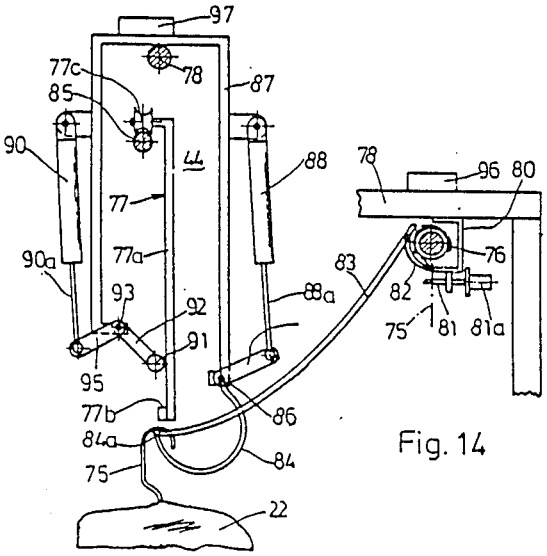
FIG. 14 is a front elevational view of the transfer arrangement of FIG. 13 in a position for receiving the suspended clothing articles from a supply screw conveyor.
Figure 15:
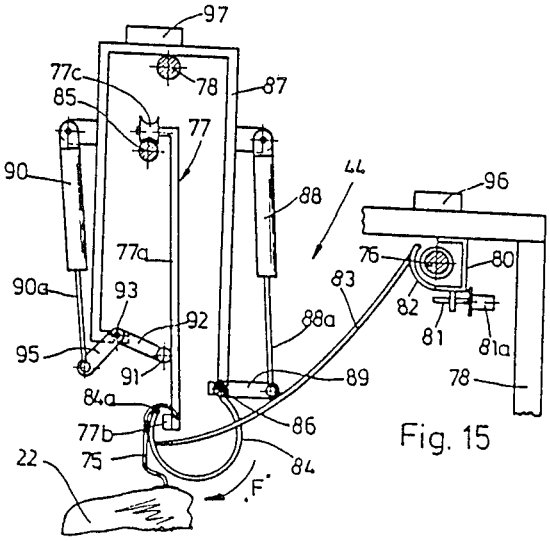
FIG. 15 is a view similar to that of FIG. 14 but with the transfer arrangement assuming its position of transferring the clothing articles to a receiving carrier.

According to the illustration of FIG. 14, the transfer guide 84 is in its receiving position for receiving the clothing articles 22 which are supplied thereto by the sliding rod 83. In this position, the sliding rod 83 terminates precisely in front of the end edge of the carrying edge portion 84*a*. This results in a interference-free transfer of the clothes hanger hooks 75 from the sliding rod 83 to the carrying edge portion 84*a*. The carrying edge portion 84 is located at a distance underneath the beam 77*b* of the vertically suspended receiving carrier 77.

In order to achieve a transfer of the clothes hanger hooks 75 from the carrying edge portion 84*a* to the beam 77*b*, the transfer guide 84, on the one hand, is pivoted upwardly about its pivoting axle 86 and, on the other hand, the receiving carrier 77 is pressed rearwardly in the direction of an arrow "E" and thus toward the pivoting axle 86 and into the trough region of the transfer guide 84, as a result of which the carrying edge portion 84*a* is also capable of pivoting around the beam 77*b* and over the latter.

For the pivoting movement of the receiving carrier 77, there is provided at least one pressurized medium operated cylinder-and-piston unit 90 which is pivotably mounted on the support 87. The pressurized medium operated cylinder-and-piston unit 90 cooperates with at least one, but preferably with two pushers 91 each of which acts on one of the upright beams 77*a* of the receiving carrier 77. Each pusher 91 is constituted by a roller, a cylindrical part or the like of rubber, synthetic plastic material or the like.

Each of the pushers 91 is mounted by means of a lever 92 on the lower end region of the front leg of the respective U-shaped frame constituting the support for up-and-down pivoting movement about a horizontal pivoting axle 93. Preferably, the two pushers 91 are connected with each other by a transverse reinforcing beam 94 so as to move in synchronism with one another.

A piston rod 90*a* of the pressurized medium operated cylinder-and-piston unit 90 is connected by means of a rocking lever 95 for joint movement with the lever 92 of the pusher 91 or with its pivoting axle 93, so that the pusher 91 is pivoted by the piston rod 90*a* against the receiving carrier 77. During this pivoting movement, the receiving carrier is angularly displaced with its rollers 77*c* about the guiding rail 85 which is constituted by a cross-sectionally circular rod. Instead of having the trough-shaped configuration, the transfer guide 84 may also be configured as an elongated rod which is provided with the carrying edge portion 84*a* and which is equipped at each of its longitudinal ends with a U-shaped bearing part by means of which the elongated rod constituting the transfer guide 84 is mounted on the pivoting axle 86 for up-and-down pivoting.

The carrying edge portion 84*a* of the transfer guide 84 also extends at a certain inclination, so that the arriving clothing articles 22 slide on the carrying edge portion 84*a* in the advancement direction "D" toward the end region of the transfer guide 84 that is remote from the sliding rod 83, until they reach an abutment 84*b* that is provided at the carrying edge portion 84*a*.

The above-discussed arrangement is provided with an electrical and/or electronic switching and control arrangement. This switching and control arrangement incorporates a counting and switching device 96 which is associated with the supply screw conveyor device 76 and is mounted on the rotatable bearing guide 80, and a switching and control device 97 for the pressurized medium operated cylinder-and-piston units 87 and 90 and for an abutment 98, which is mounted on the frame 78 and is associated with the receiving carrier 77 and with the transfer guide 84. The abutment 98 is associated with the guiding rail 85 and holds the receiving carrier 77 firmly in position for and during the performance of the transfer operation, while releasing the same after the completion of the transfer operation, so that the receiving carrier 77 carrying a number of the clothing articles 22 can be moved on the guiding rail 85 out of the region of the transfer guide 84 to its destination, such as to the supplying device 23 for the performance of the packaging operation, or to a storage area. This abutment 98 is constructed similarly if not identically to the abutment 81, is mounted on the frame 78 and projects into the trajectory of movement of the rollers 47*c* when in its extended condition.

The transfer of the clothing articles 22 is accomplished in the following manner:

The clothing articles 22 which hang on the clothes hangers 75*a* are fed either manually or automatically to the supply screw conveyor device 76 at the region between the motor drive 79 and the rear abutment 81, in that the clothes hanger hooks 75 are hooked onto the supply screw conveyor device 76. At this time, the front abutment 81 which is situated close to the motor drive 79 is in its retracted or inactive condition in which it permits passage, and the rear abutment 81 which is situated close to the lifting device 82 is in its extended or active condition in which it extends underneath the supply screw conveyor device 76, so that the suspended clothing articles 22 advance along the supply screw conveyor device 76 in he advancement direction "D" toward the rear abutment (tappet) 81 until they are stopped by the latter Simultaneously, one receiving carrier 77 has been moved on the guiding rail 85 into the region of the transfer guide 84 and rests there in front of the abutment 98. The transfer guide 84 is in its pivoted receiving position which is shown in FIG. 14 of the drawing.

The clothing articles 22 supplied to the supply screw conveyor device 76 are registered by the counting and switching device 96 and, once the desired number is reached, the front abutment 81 is also displaced into its extended stoppage position. Because of this, no additional clothing articles 22 are able to enter the space between the two abutments 81, and the following clothing articles 22 are being temporarily held back.

While it is true that the supply screw conveyor device 76 continues to operate or turn, the loaded clothing articles 22 nevertheless remain stationary between the abutments 81. After the counting and switching device 96 has determined that the desired number of the clothing articles 22 has been loaded on the supply screw conveyor device 76, and after the front abutment 81 has been moved into its extended stoppage position, the counting and switching device 96 causes the rear abutment 81 as considered in the advancement direction "D" to move toward its retracted releasing position, so that the supply screw conveyor device resumes the advancement of the clothing articles 22 in the advancement direction "D". During this resumed advancement, the clothes hanger hooks 75 associated with the respective clothing articles 22 run onto the inclined and/or arcuate lifting device 82, which rises upwardly in the advancement direction "D", and are lifted thereby out of the supply screw conveyor device 76 and transferred to the sliding rod 83. The hooks 75 of the clothing articles 22 then slide downwardly on the sliding rod 83 onto the carrying edge portion 84*a* of the transfer guide 84 and along the latter up to its rear end, where the carrying edge portion 84*a* is equipped with the abutment 84*b*.

When the carrying edge portion 84*a* is loaded with the number of the clothing articles 22 supplied by the supply screw conveyor device 76 in such a manner that such loaded clothing articles 22 are arranged in a row along the length of the carrying edge portion 84*a*, the counting and switching device, on the one hand, registers that the region of the supply screw conveyor device 76 that is situated between the abutments 81 has been emptied and, as a result, causes the front abutment 81 to move into its releasing position and the rear abutment 81 to move into its stopping position, so that new clothing articles 22 can be introduced onto the supply screw conveyor device 76 between the two abutments 81. On the other hand, the switching and control device 97 simultaneously registers that the transfer guide 84 is loaded with clothing articles 22 to be transferred and the operation of the two pressurized medium operated cylinder-and-piston units 88 and 90 is controlled in response to this determination. The pressurized medium operated cylinder-and-piston unit 90 moves the pushers 91 by means of its piston rod 90*a* and the levers 92 and 95 about the pivoting axle 93 against the beams 77*a* of the receiving carrier 77. The beams 77*a* then move the receiving carrier 77 in the direction of the arrow "E" through a predetermined pivoting range. Simultaneously therewith, or subsequently thereto, the pressurized medium operated cylinder-and-piston unit 88 moves the transfer guide 84 by means of its piston rod 88*a* and the swivelling lever 89 about the pivoting axle 86 in the direction of an arrow "F", as a result of which the carrying edge portion 84*s* with the clothes hanger hooks 75 hanging thereon is pivoted around the beam 77*b* and over the beam 77*b*, so that the clothes hanger hooks 75 overlap the beam 77*b* (compare the pivoted transfer position according to FIG. 15).

Now, the action of the pressurized medium operated cylinder-and-piston unit 88 and the swivelling lever 89 returns the transfer guide 84 into its original position of FIG. 14. During this return movement, the carrying edge portion 84*a* moves below the clothes hanger hooks 75 and out of the latter, while the clothes hanger hooks which overlap the beam 77*b* are slightly lowered onto the beam 77*b* and are thereafter carried by the beam 77*b*. At this time, the transfer is accomplished and the clothing articles 22 are suspended from the beam 77*b* of the receiving carrier 77. Now, the backwardly pivoting pushers 91 release the receiving carrier 77 and the latter with its rollers 77*c* is angularly displaced about the frame 78 back into its vertical suspended position of FIG. 14 of the drawing, as a result of its own weight, or aided by a spring force. The receiving carrier 77 can then, and after the release of the abutment 98 under the control of the switching and control device 97, be displaced on the guiding rail 85 in the advancement direction "D" out of the operating range of the transfer guide 84 and to its destination.

Simultaneously therewith, a new receiving carrier 77 is moved on the guiding rail 85 all the way to the abutment 98, which has once more become operational, so that a new transfer operation can be commenced.

The downwardly inclined sliding rod 83 and the carrying edge portion 84*a* which is also inclined downwardly as considered in the advancement direction "D", are provided with sliding facilitating surfaces, as a result of which the clothes hanger hooks 75 can easily and automatically slide thereon. The inclined position of the guiding rail 85 is so selected that the receiving carriers 77 can also easily move in the advancement direction "D" all the way to in front of the abutment 98 and, after the displacement of the latter into its releasing position, continue its movement. This transfer arrangement 44 can be used for the transfer either of the not-yet-packaged clothing articles 22 or of the clothing articles 22 which have already been packaged in the hose-shaped foil portions 14*a*, as desired.

It is contemplated within the framework of the present invention to arrange the supply screw conveyor device 76 in alignment with the trough-shaped transfer guide 84 and, as a result, to be able to dispense with the sliding rod 83 which has been described above as being interposed between the supply screw conveyor device 76 and the transfer guide 84, so that the clothes hanger hooks 75 associated with the respective clothing articles 22 are slid directly from the supply screw conveyor device 76 onto the carrying edge portion 84*a* of the transfer guide 84.

In a modified implementation of the transfer arrangement 44 which is illustrated in FIGS. 16 to 22 of the drawing where the same reference numerals as before have been used to identify corresponding parts, and which basically corresponds in principle and in operation to the implementation of the transfer arrangement 44 that has been discussed above in conjunction with FIGS. 13 to 15 of the drawing, the clothing articles 22 ar to be transferred from the movable receiving carriers 77 onto the supply screw conveyor device 76. This particular implementation is especially suited for the handling of the clothing articles 22 which have not yet been packaged (i.e. not yet covered by a protective foil bag or pouch) and in this application is arranged upstream of the packaging machine of FIGS. 1 to 10.

In this construction of the transfer arrangement 44, the pivoting axle 86 mounts the transfer guide 84 on carriages 99 which are movable transversely to the advancement direction "D". The carriages 99 are supported on guides by means of rollers.

Herein, the supply screw conveyor device 76 is situated at a distance behind the displaceable receiving carriers 77 and the transfer guide 84 moves to and fro between the receiving carriers 77 and the supply screw conveyor device 76.

Figure 13:
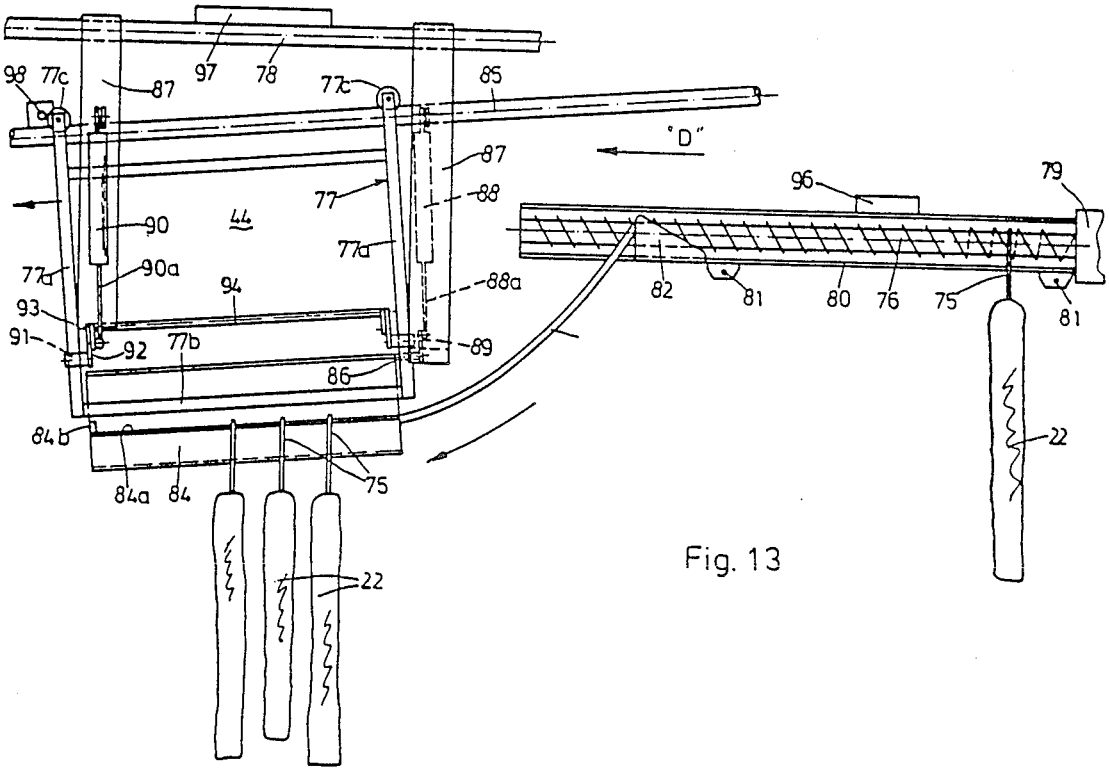
FIG. 13 is a front elevational view of a transfer arrangement for suspended clothing articles for use in the packaging machines of FIGS. 1 and 9.

The clothing articles 22 which have already been transferred to the supply screw conveyor device 76 are being monitored by a non-illustrated electrical and/or electronic switching and control device, which corresponds to the switching and control device 96 and 97 that is shown in FIG. 13 of the drawing. Inasmuch as the supply screw conveyor device 76 is filled, the receiving carrier 77 which also carries respective clothing articles 22 is positioned in its waiting position.

When the clothing articles 22 have been transported away from the supply screw conveyor device 76 in the direction of the arrow "D", the receiving carrier 77 is displaced into its transfer position illustrated in FIG. 18 of the drawing, in which it is located next to the transfer guide 84. After this has occurred, the transfer guide 84 is pivoted upwardly in the direction of the arrow "F" and takes the clothing articles 22 over from the receiving carrier 77, as indicated in FIG. 19 of the drawing. Thereafter, the receiving carrier 77 is pivoted rearwardly in the direction of the arrow "E" and the transfer guide 84 with the clothing articles 22 is pivoted downwardly and is displaced rearwardly in the direction indicated by an arrow "G" underneath the receiving carrier 77 by means of its carriages 99, as indicated in FIG. 20 of the drawing.

At this time, the receiving carrier 77 can be again pivoted frontwardly, as indicated in FIG. 21 of the drawing, and the transfer guide 84 is again pivoted upwardly and continues its rearward movement in the direction of the arrow "G" into its original position, as also indicated in FIG. 21 of the drawing.

The supply screw conveyor device 76 transports the clothing articles 22 received thereby away and the transfer guide 84 takes new clothing articles 22 over from the receiving carrier 77, whereafter the above-discussed transfer operation is repeated.

The taking-over of the clothing articles 22 from the transfer guide 84 onto the receiving carrier 77 and the pivotal movements of these two components in the implementation of FIGS. 18 to 20, except that the transfer guide 84 is not being moved from one location to another in and opposite to the direction of the arrow "G".

While the present invention has been described and illustrated herein as embodied in a specific construction of a packaging machine for clothing articles, it is not limited to the details of this particular construction, since various modifications and structural changes are possible and contemplated by the present invention. Thus, the scope of the present invention will be determined exclusively by the appended claims.

What is claimed is:

1. A packaging machine for packaging objects, especially clothing articles, in a packaging portion of a hose-shaped synthetic plastic material foil that is contained on a roll, comprising:

a machine frame;

means for rotatably mounting the roll of the synthetic plastic material foil on said machine frame;

means for guiding the foil unwound from the roll along a predetermined path to an upper region of said machine frame, including diverting rollers engaging the unwound foil;

means for opening the hose-shaped foil at said upper region of said machine frame;

means for welding the foil at said upper region of said machine frame along a predetermined imaginary line situated between the packaging portion and the remainder of the foil with attendent formation of an upper welding seam, and for dissociating the packaging portion at said upper welding seam from the remainder of the foil;

means for supporting the objects to be packaged;

means for pulling the opened hose-shaped foil downwardly over the clothing article to be packaged, including a foil-pulling carriage guided on said machine frame for an up-and-down displacement, and means including a motor for upwardly and downwardly displacing said carriage;

lower welding means mounted on said carriage for joint movement therewith and operative for welding the packaging portion of the foil after it has been pulled all the way over the clothing article being packaged, at a location disposed downwardly of the clothing article, with attendant formation of a lower welding seam; and means for transporting the clothing articles hanging on clothes hangers having respective hooks, including a supply conveyor, a displaceable receiving carrier including a carrier beam, and means for transferring the clothing articles suspended by the hooks of their hangers from said supply conveyor to said receiving carrier, including a transfer guide which receives the clothing articles in their suspended positions from said supply conveyor, and means to pivot the transfer guide up and down about a horizontally and inclinedly extending pivoting axle, thereby transferring the clothing articles to said receiving carrier in such a manner that the hooks of their hangers engage and extend over and partially around said carrier beam.

2. The packaging machine as defined in claim 1, wherein said transfer guide includes a supporting edge portion for supporting the hooks of the clothes hangers, said supporting edge portion being inclined downwardly in an advancement direction of the clothing articles, being situated in its clothing article receiving position at a lower elevation than said carrier beam, and being mounted for tilting around and above said carrier beam for the transfer of the clothing articles to the latter; wherein said transfer guide has a cross-sectionally U-shaped configuration bounding a receiving channel and including front and rear arms, of which said front arm constitutes said supporting edge portion; and further comprising an auxiliary support, a holding device mounted on said auxiliary support, and a pivoting axle mounting the rear one of said arms of said transfer guide on said holding device for pivoting thereabout.

3. The packaging machine as defined in claim 2, and further comprising first and second pressurized medium operated cylinder-and-piston units each articulately mounted on said holding device and including a piston rod, means for connecting said piston rod of said first cylinder-and-piston unit with said transfer guide for pivotally displacing the latter in response to movement of said piston rod, and at least one pusher mounted on said holding device for pivoting relative thereto and for displacement relative to said receiving carrier and connected to said piston rod of said second cylinder-and-piston unit for so pivotally displacing said receiving carrier oppositely to the pivoting direction of said transfer guide in response to movement of said piston rod of said second cylinder-and-piston unit that said carrier beam of said receiving carrier is introduced into said receiving channel of said transfer guide.

4. The packaging machine as defined in claim 3, wherein said receiving carrier further includes at least one connecting beam; further comprising an additional pusher similar to said one pusher, said pushers acting on said connecting beam of said receiving carrier; and further comprising a horizontal pivoting axle supported on said holding device, two rocking levers each mounting one of said pushers on said horizontal pivoting axle, a transverse reinforcing rod rigidly connecting said pushers with one another, and an additional rocking lever connecting said reinforcing rod with said piston rod of said second cylinder-and-piston unit.

5. The packaging machine as defined in claim 3, wherein said holding device includes two U-shaped frames having respective downwardly oriented front and rear arms; wherein said transfer guide is mounted on said rear arms of said U-shaped frames; and wherein said at least one pusher is mounted on said front arms of said U-shaped frames.

6. The packaging machine as defined in claim 3, wherein said pusher is constructed as a roller.

7. The packaging machine as defined in claim 3, wherein said pusher is of rubber, synthetic plastic material, and the like.

8. The packaging machine as defined in claim 1, further comprising an auxiliary support; wherein said supply conveyor includes a supply screw, a bearing guide mounting said supply screw on said auxiliary support for rotation about a longitudinal axis thereof, and a motor driving said supply screw in rotation; and further comprising two abutment members mounted in said bearing guide at a predetermined distance from one another in the longitudinal direction of said supply screw for movement between extended positions in which they delimit a receiving zone for a number of the clothing articles to be transferred and prevent passage of the clothing articles on the supply screw past them, and retracted positions in which they allow such passage, and means for individually moving each of said abutments between its extended and its retracted positions.

9. The packaging machine as defined in claim 8, wherein said moving means includes a separate pressurized medium operated cylinder-and-piston unit for each of said abutments, said unit having a piston rod constituting said abutment.

10. The packaging machine as defined in claim 8, wherein said moving means includes a separate lifting magnet unit for each of said abutments, said unit having a tappet constituting said abutment.

11. The packaging machine as defined in claim 8, and further comprising means for lifting the hooks of the clothes hangers on which the clothing articles hang off from said supply conveyor, including a ramp surface that is upwardly inclined as considered in the advancement direction of the clothing articles on said supply screw, and a sliding rod mounted on said auxiliary support and extending from a downstream end of said ramp surface to an upstream end of said transfer guide along a course which is downwardly inclined in the clothing article advancement direction.

12. The packaging machine as defined in claim 11, wherein said ramp surface follows a substantially straight path.

13. The packaging machine as defined in claim 11, wherein said ramp surface follows an arcuate path.

14. The packaging machine as defined in claim 11, wherein said course of said sliding rod is substantially straight.

15. The packaging machine as defined in claim 11, wherein said course of said sliding rod is arcuate.

16. The packaging machine as defined in claim 1, further comprising an auxiliary support, means including rollers for displaceably supporting said receiving carrier, abutment means mounted on said auxiliary support for movement between retracted and extended positions thereof in which they are situated out of and in the path of movement of said rollers, respectively, and operative in said extended position thereof for fixing said receiving carrier in its transfer position.

17. The packaging machine as defined in claim 1, and further comprising means for guiding said transfer guide for movement transversely to the advancement direction of the clothing articles between said receiving carrier and said supply screw conveyor.

18. The packaging machine as defined in claim 17, wherein said guiding means includes guiding rods, and at least one support carriage supporting said transfer guide and supported on said guiding rods for movement longitudinally thereof.

* * * * *